US007288893B2

(12) United States Patent
Ito et al.

(10) Patent No.: US 7,288,893 B2
(45) Date of Patent: Oct. 30, 2007

(54) GAS DISCHARGE TUBE

(75) Inventors: Yoshinobu Ito, Hamamatsu (JP); Masaki Ito, Hamamatsu (JP); Koji Matsushita, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 266 days.

(21) Appl. No.: 10/544,465

(22) PCT Filed: Feb. 12, 2004

(86) PCT No.: PCT/JP2004/001495

§ 371 (c)(1),
(2), (4) Date: Aug. 4, 2005

(87) PCT Pub. No.: WO2004/073011

PCT Pub. Date: Aug. 26, 2004

(65) Prior Publication Data

US 2006/0145580 A1 Jul. 6, 2006

(30) Foreign Application Priority Data

Feb. 12, 2003 (JP) ..... 2003-034238

(51) Int. Cl.
*H01J 17/02* (2006.01)
*H01J 61/02* (2006.01)

(52) U.S. Cl. ..... 313/609; 313/610; 313/611

(58) Field of Classification Search ..... 313/103 R, 313/609–613, 623, 634, 637, 542–544; 250/214 VT
See application file for complete search history.

(56) References Cited

U.S. PATENT DOCUMENTS 5,191,260 A 3/1993 Kawai et al.
5,552,669 A 9/1996 Ikedo et al.
5,587,625 A 12/1996 Ikedo et al.
5,619,101 A 4/1997 Ikedo et al.
5,633,563 A 5/1997 Ikedo et al.

(Continued)

FOREIGN PATENT DOCUMENTS

EP 0 473 378 B1 3/1992

(Continued)

*Primary Examiner*—Joseph Williams
*Assistant Examiner*—Bumsuk Won
(74) *Attorney, Agent, or Firm*—Drinker Biddle & Reath LLP

(57) ABSTRACT

A gas discharge tube 10 of the present invention generates an electric discharge between an anode part 24 and a cathode part 52 disposed inside a sealed container 12 in which gas has been sealed. The gas discharge tube 10 includes an electric discharge path restricting part 28 which is cylindrical and disposed between the anode part and the cathode part, and which has a throughhole 46 for narrowing an electric discharge path between the anode part and the cathode part; and a supporting part 30 which supports the electric discharge path restricting part and which is electric insulating. The electric discharge path restricting part is provided at its tip portion with a projecting part 44 which is cylindrical and projects toward the cathode part side. Letting the outer diameter and height of the projecting part 44 be "D" and "H," respectively, then D/H is in the range of 0.5 to 2.0. With this structure, it is possible to generate an intense electric field in the vicinity of the tip of the projecting part. This can decrease a startup voltage, thereby ensuring the generation of an electric discharge.

5 Claims, 5 Drawing Sheets

U.S. PATENT DOCUMENTS

| | | | | |
|---|---|---|---|---|
| 5,646,487 | A | 7/1997 | Ikedo et al. | |
| 5,684,363 | A | 11/1997 | Ikedo et al. | |
| 5,698,945 | A | 12/1997 | Ikedo et al. | |
| 5,886,470 | A | 3/1999 | Smolka | |
| 6,380,663 | B1 | 4/2002 | Ikedo et al. | |
| 6,531,821 | B1 | 3/2003 | Ikedo et al. | |
| 6,559,576 | B1 | 5/2003 | Ikedo et al. | |
| 6,573,655 | B1 | 6/2003 | Ikedo et al. | |
| 6,586,866 | B1 | 7/2003 | Ikedo et al. | |
| 6,741,036 | B1 | 5/2004 | Ikedo et al. | |
| 6,873,107 | B2 * | 3/2005 | Kawai et al. | 313/623 |
| 6,956,326 | B2 * | 10/2005 | Kawai et al. | 313/609 |
| 2004/0021419 | A1 | 2/2004 | Ito et al. | |
| 2004/0041523 | A1 | 3/2004 | Kawai et al. | |
| 2004/0046506 | A1 | 3/2004 | Kawai et al. | |

FOREIGN PATENT DOCUMENTS

| | | | |
|---|---|---|---|
| EP | 0 685 874 | B1 | 12/1995 |
| EP | 0 700 071 | B1 | 3/1996 |
| EP | 1 143 486 | A1 | 10/2001 |
| EP | 1 154 462 | B1 | 11/2001 |
| JP | 05-159749 | A | 6/1993 |
| JP | 06-215734 | A | 8/1994 |
| JP | 07-288106 | A | 10/1995 |
| JP | 10-064479 | | 3/1998 |
| JP | 2000-173547 | | 6/2000 |
| JP | 2001-256924 | | 9/2001 |
| JP | 2002-151008 | | 3/2002 |
| JP | 2002-151009 | | 3/2002 |
| JP | 2002-151010 | | 3/2002 |
| WO | WO 02/41359 | | 3/2002 |
| WO | 03/030208 | A1 | 4/2003 |
| WO | 03/094199 | A1 | 11/2003 |

* cited by examiner

GAS DISCHARGE TUBE

TECHNICAL FIELD

The present invention relates to a gas discharge tube such as a heavy hydrogen lamp to be used particularly as a light source for spectroscopy, chromatography, etc.

BACKGROUND ART

As conventional techniques in the above-described field, those disclosed in Japanese Unexamined Patent Publication No. H7-288106 and Japanese Unexamined Patent Publication No. H10-64479 are known. In either gas discharge tube, a barrier wall made of metal is disposed on an electric discharge path between an anode part and a cathode part, and a small hole is formed on the barrier wall so as to narrow the electric discharge path. In such a structure, light with high brightness can be obtained by the small hole on the electric discharge path. In particular, in the gas discharge tube of Japanese Unexamined Patent Publication No. H7-288106, brightness is further increased by extending the length of the small hole, that is, a portion of the electric discharge path that is narrowed. On the other hand, in the gas discharge tube disclosed in Japanese Unexamined Patent Publication No. H10-64479, higher brightness is achieved by disposing a plurality of barrier walls in addition to extending the length of the hole to be used.

The demand for higher brightness in the technical field of gas discharge tubes has been comparatively satisfied by the techniques disclosed in the above-described patent publications.

However, when a portion of the electric discharge path that is narrowed is extended in length, an electric discharge is less liable to occur. To avoid this problem, in the gas discharge tube disclosed in Japanese Unexamined Patent Publication No. H10-64479, a plurality of metal barrier walls are disposed to generate an electric discharge step by step; however, this results in complicating a power supply circuit.

Therefore, an object of the present invention is to provide a gas discharge tube which can securely generate an electric discharge, regardless of the length of a portion of the electric discharge path that is narrowed.

DISCLOSURE OF THE INVENTION

In order to achieve the aforementioned object, the present invention provides a gas discharge tube comprising: a sealed container in which gas is contained; an anode part disposed in the sealed container; a cathode part defining an electric discharge part for generating an electric discharge with the anode part, the cathode part being disposed inside the sealed container in such a manner as to be distanced from the anode part; an electric discharge path restricting part being cylindrical and conductive and having a throughhole for narrowing the electric discharge path, the electric discharge path restricting part being disposed between the anode part and the cathode part, and being electrically connected with an external power source; and an electric-discharge-path-restricting-part supporting part which supports the electric discharge path restricting part and which is electrically insulating, wherein the electric discharge path restricting part has a projecting part which is cylindrical and projects toward the cathode part side, and a ratio (D/H) of an outer diameter (D) of the projecting part to a height (H) of the projecting part is in a range of 0.5 to 2.0.

In such a structure where the electric discharge path restricting part projects toward the cathode part, and D/H is in the range of 0.5 to 2.0, the electric discharge path restricting part and the cathode part have a non-uniform electric field therebetween, and can generate an intense electric field in the vicinity of the tip of the projecting part, thereby decreasing a startup voltage. This facilitates the generation of a startup discharge, thereby ensuring the generation of the main discharge.

It is effective to make the outer diameter of the projecting part of the electric discharge path restricting part be in the range of 1.0 mm to 2.0 mm. This can effectively generate the startup discharge to be generated between the cathode part and the electric discharge path restricting part exclusively at the tip portion and in the vicinity of the throughhole in the projecting part of the electric discharge path restricting part.

It is also preferable that the throughhole in the electric discharge path restricting part includes a small hole part which is provided on the anode part side and has a constant inner diameter, and an increased diameter hole part which is linked with the small hole part and extends toward the cathode part side while increasing in diameter toward the cathode part side. The small hole part mainly functions as a part for narrowing the electric discharge path, and the increased diameter hole part forms an excellent arc ball inside, thereby contributing to high brightness. In addition, in a condition where the increased diameter hole part has a conical inner peripheral surface, a depth (A) in the range of 0.3 mm to 1.3 mm and an opening angle (θ) in the range of 60° to 90°, it becomes possible to form a further stable arc ball.

The aforementioned features and advantages and other features and advantages of the present invention will be made clear to those skilled in the art through the following detailed description with reference to accompanying drawings.

BEST MODES FOR CARRYING OUT THE INVENTION

Now, preferable embodiments of the gas discharge tube of the present invention will be described in detail with reference to accompanying drawings. In the following description, it is to be understood that various terms indicating directions such as "upeardly", "dowinwardly" and the like are referred to based on the conditions of corresponding drawings for the sake of convenience, and should not be construed as limiting terms.

FIRST EMBODIMENT

Figure 1:
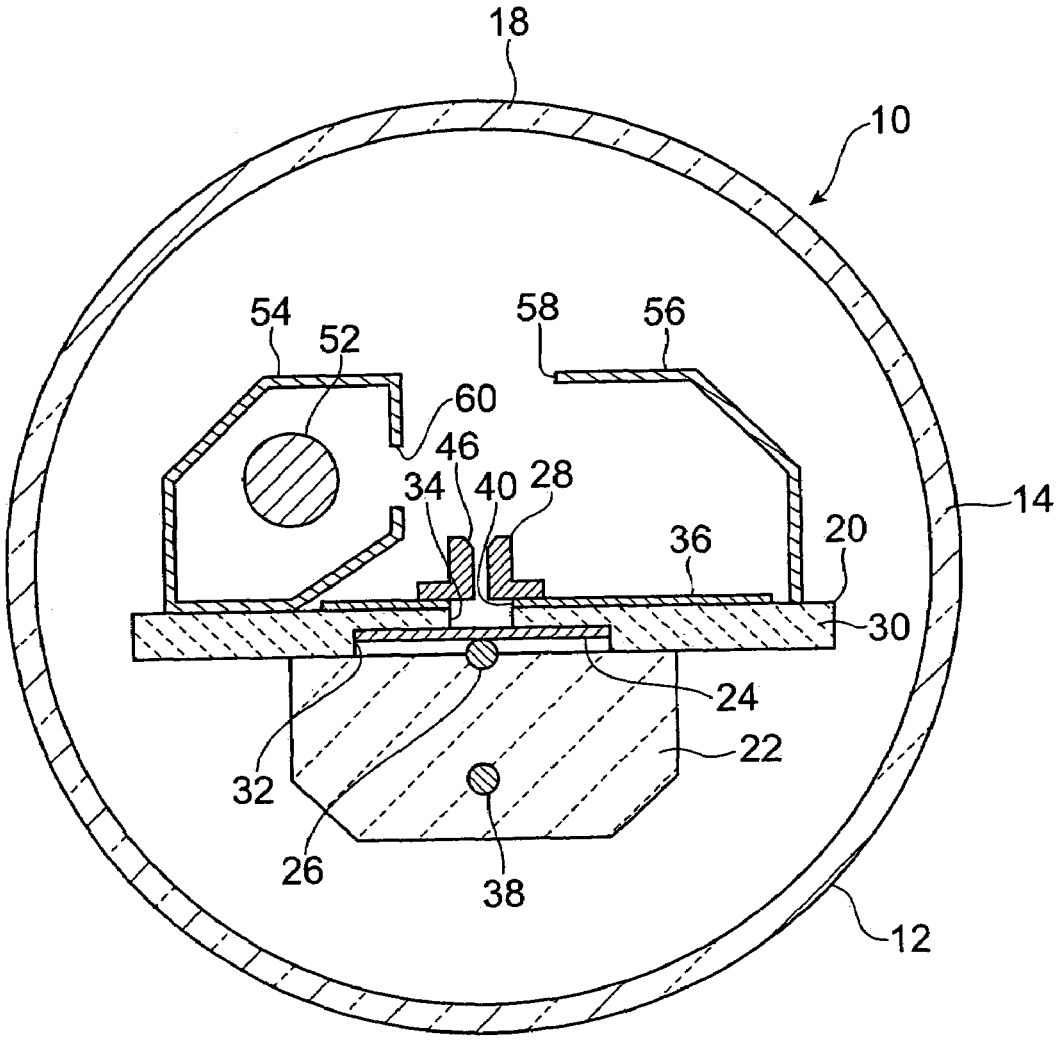
FIG. 1 is an end view showing a gas discharge tube according to a first embodiment of the present invention.

FIG. 1 shows an end view of a gas discharge tube according to a first embodiment of the present invention that is cut in the direction orthogonal to the axis (tube axis). A gas discharge tube 10 shown in FIG. 1 is a side-on type heavy hydrogen lamp. Specifically, the gas discharge tube 10 has a sealed container 12 made of glass in which several hundreds of Pa of heavy hydrogen gas has been sealed. The sealed container 12 comprises a side tube part 14 which is cylindrical and sealed at one end thereof, and a stem part (not shown) for sealing the other end of the side tube part 14. A portion of the side tube part 14 is used as a light emitting window 18. The sealed container 12 accommodates a light emission part assembly 20 therein.

The light emission part assembly 20 includes a base part 22 which is electrically insulating, made of ceramics or the like. The base unit 22 is disposed opposed to the light emitting window 18. Above the base part 22 is formed a tabular anode part 24. Onto the rear side of the anode part 24, a tip portion of a stem pin 26 is fixedly connected electrically. The tip portion extends in the direction of the tube axis (the center axis of the side tube part 14), and stands on the stem part.

The light emission part assembly 20 also has an electric-discharge-path-restricting-part supporting part (hereinafter referred to as supporting part) 30 for supporting an electric discharge path restricting part 28 that will be described later. The supporting part 30 is fixed on the upper surface of the base part 22. The supporting part 30 is thicker than the anode part 24, and has a concave part 32 on the bottom surface center thereof to dispose the anode part 24. When the anode part 24 is disposed in the concave part 32 and the supporting part 30 is fixed to the base part 22, the anode part 24 is sandwiched between the stem pin 26 and the supporting part 30. The supporting part 30 also has an opening 34 in its center, which forms part of the electric discharge path.

Furthermore, a conductive plate 36 is disposed on the upper surface of the supporting part 30. The conductive plate 36 is electrically connected with the tip portion (nor shown) of a stem pin 38 standing on the stem part. The conductive plate 36 has an opening 40 in its center, which is disposed coaxially with the opening 34 of the supporting part 30 so as to form part of the electric discharge path when the conductive plate 36 is fixed on the supporting part 30.

The light emission part assembly 20 also includes a cathode part 52 which is disposed outside the light path on the light emission window 18 side. The cathode part 52 is provided for generating thermal electrons, and more specifically, is formed by coating electron emitting material onto a coil which is extended in the tube axial direction and is made of tungsten. The cathode part 52 is electrically connected with the tip portion of an unillustrated stem pin standing on the stem part via a connection pin so as to allow feeding of electric power from outside.

Figure 2:
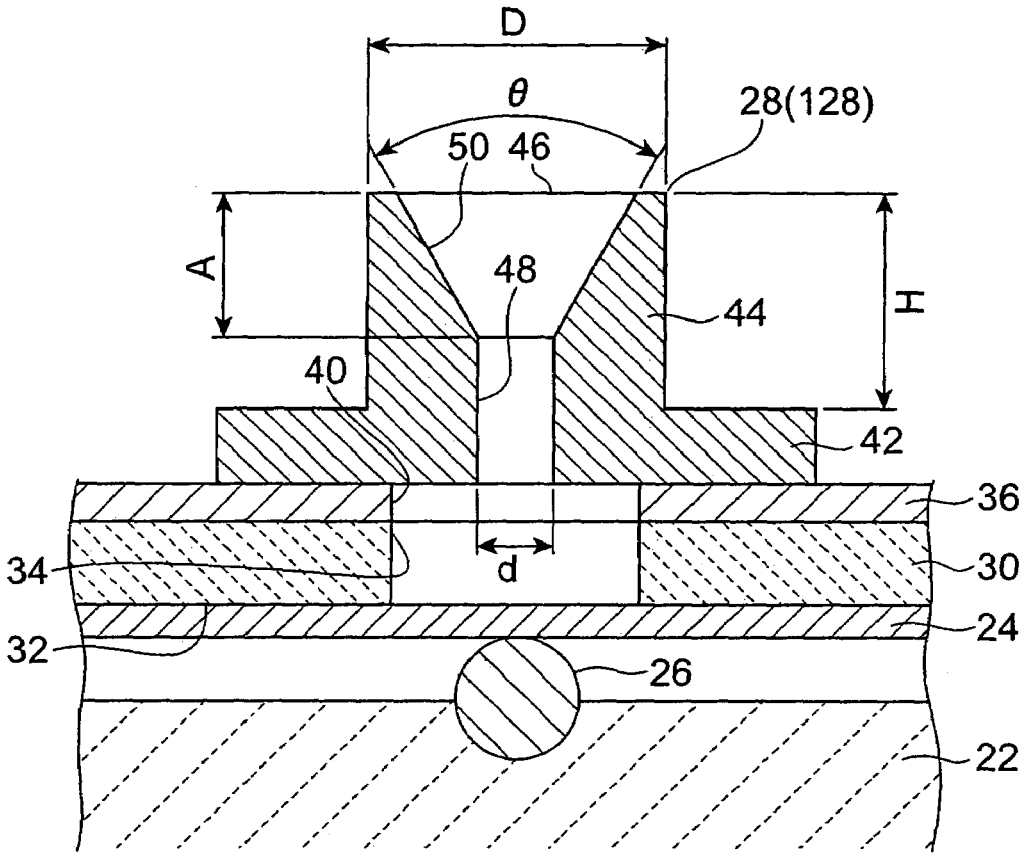
FIG. 2 is an enlarged cross sectional view of an electric discharge path restricting part in the gas discharge tube shown in FIG. 1.

As clearly shown in FIG. 2, the electric discharge path restricting part 28 is shaped like a cylinder, and is provided with a flange part 42 for fixing at the end on the conductive plate 36 side. The cylindrical part of the electric discharge path restricting part 28 that projects upward from the flange part 42 is referred to as a projecting part 44, and the projecting part 44 has an outer diameter "D" preferably in the range of 1.0 mm to 2.0 mm. In addition, letting the height or amount of projection of the projecting part 44 be "H," the relationship D/H between "H" and the outer diameter "D" of the projecting part 44 is preferably in the range of 0.5 to 2.0. The inside of the electric discharge path restricting part 28 makes a throughhole 46 for narrowing the electric discharge path, and the throughhole 46 is formed of a small hole part 48 which is provided on the anode part 24 side in such a manner as to have a constant inner diameter, and of an increased diameter hole part 50 which is linked with the small hole part 48 and extends upward while increasing in diameter in a funnel shape. The small hole part 48 is a part for mainly narrowing the electric discharge path, and has an inner diameter of approximately 0.5 mm. The increased diameter hole part 50 is a part for mainly forming an arc ball, and in the illustrated embodiment, has a conical inner peripheral surface. The increased diameter hole part 50 has a depth (length) "A" preferably in the range of 0.5 mm to 1.3 mm, and an opening angle θ preferably in the range of 60° to 90°.

The throughhole 42 of the electric discharge path restricting part 28 is formed of a small hole part 46 which is provided on the anode part 24 side in such a manner as to have a constant inner diameter, and of an increased diameter hole part 48 which is linked with the small hole part 46 and extends upward while increasing in diameter in a funnel shape. The small hole part 46 is mainly for narrowing the electric discharge path, and the increased diameter hole part 48 is mainly for forming an arc ball, and in the present embodiment, has a cone-shaped inner peripheral surface. In order to narrow the electric discharge path, it is preferable that the small hole part 46 has an inner diameter D1 of 0.5 mm or so. In addition, it is preferable that a maximum inner diameter D2 of the increased diameter hole part 48, that is, the inner diameter D2 of the throughhole 42 on the end surface on the cathode side be in the range of 1 mm to 3 mm, and it is further preferable that D2/D1 or the ratio of the inner diameter D2 to the diameter D1 of the small hole part 46 is in the range of 4 to 10.

The light emission part assembly 20 also includes an electric discharge distributor 54 made of metal and a front surface cover 56 in order to prevent materials spattered or evaporated from the cathode part 52 from adhering to the light emission window 18. The electric discharge distributor 54 is disposed to surround the cathode part 52 and is fixed on the upper surface of the supporting part 30. The front surface cover 56 is opposite the electric discharge distributor 54 and is fixed on the upper surface of the supporting part 30. Between the electric discharge distributor 54 and the front surface cover 56, a light passage opening 62 for letting discharge light pass through is formed. The electric discharge distributor 54 has an opening 60 formed in a portion that faces the front surface cover 56, and thermal electrons generated in the cathode part 52 pass through the opening 60.

Now, operations of the above-mentioned gas discharge tube 10 will be described.

First, before an electric discharge, for 20 seconds or so, electric power of approximately 10 W is supplied to the cathode part 52 from a cathode external power source (nor shown) via a stem pin (nor shown) so as to preheat a coil composing the cathode part 52. Next, a voltage of approximately 160V is applied between the cathode part 52 and the anode part 24 from a main discharge external power source (nor shown) via the stem pin 26, thereby preparing an arc discharge.

Later, a predetermined voltage is applied between the electric discharge path restricting part 28 and the anode part 24 via the stem pins 38 and 26 from a trigger external power source (nor shown). As a result, a startup discharge occurs between the cathode part 52 and the tip of the projecting part 44 of the electric discharge path restricting part 28 projecting on the cathode part 52 side.

In this embodiment, the electric discharge path restricting part 28 has a shape that makes the ratio D/H between the outer diameter "D" of the projecting part 44 and its height "H" be in the range of 0.5 to 2.0, so that the electric discharge path restricting part 28 and the cathode part 52 have a non-uniform electric field therebetween, and have an intense electric field particularly in the vicinity of the tip of the projecting part 44. This can decrease a startup voltage for generating the startup discharge. Since the outer diameter "D" of the projecting part 44 is in the range of 1.0 mm to 2.0 mm, the startup discharge to be generated between the cathode part 52 and the electric discharge path restricting part 28 can be effectively generated exclusively in the vicinity of the increased diameter hole part 50 of the projecting part 44 of the electric discharge path restricting part 28. This also facilitates the generation of the startup discharge.

The successful generation of the startup discharge ensures the generation of a main discharge (arc discharge) between the cathode part 52 and the anode part 24 by the main discharge external electrode. After generating the main discharge, the electric power from the cathode external power source is adjusted to optimize the temperature of the cathode part 52. This maintains the main discharge between the cathode part 52 and the anode part 24, and forms an arc ball inside the increased diameter hole part 50 of the projecting part 44 of the electric discharge path restricting part 28. Since the electric discharge path is narrowed with a sufficient length in the electric discharge path restricting part 28 and the arc ball is formed, ultraviolet rays generated are released outside as light with extremely high brightness after passing through the light emission window 18 of the sealed container 12 from the light passage opening 58 between the electric discharge distributor 54 and the front surface cover 56. In the present embodiment the inner peripheral surface of the increased diameter hole part 50 of the projecting part 44 is conical; the depth "A" of the increased diameter hole part 50 of the projecting part 44 is in the range of 0.5 mm to 1.3 mm; and the opening angle θ of the increased diameter hole part 50 is in the range of 60° to 90°, so that the arc ball is formed in a stable and excellent shape. Consequently, the light to be emitted is stable in brightness and amount.

SECOND EMBODIMENT

Figure 3:
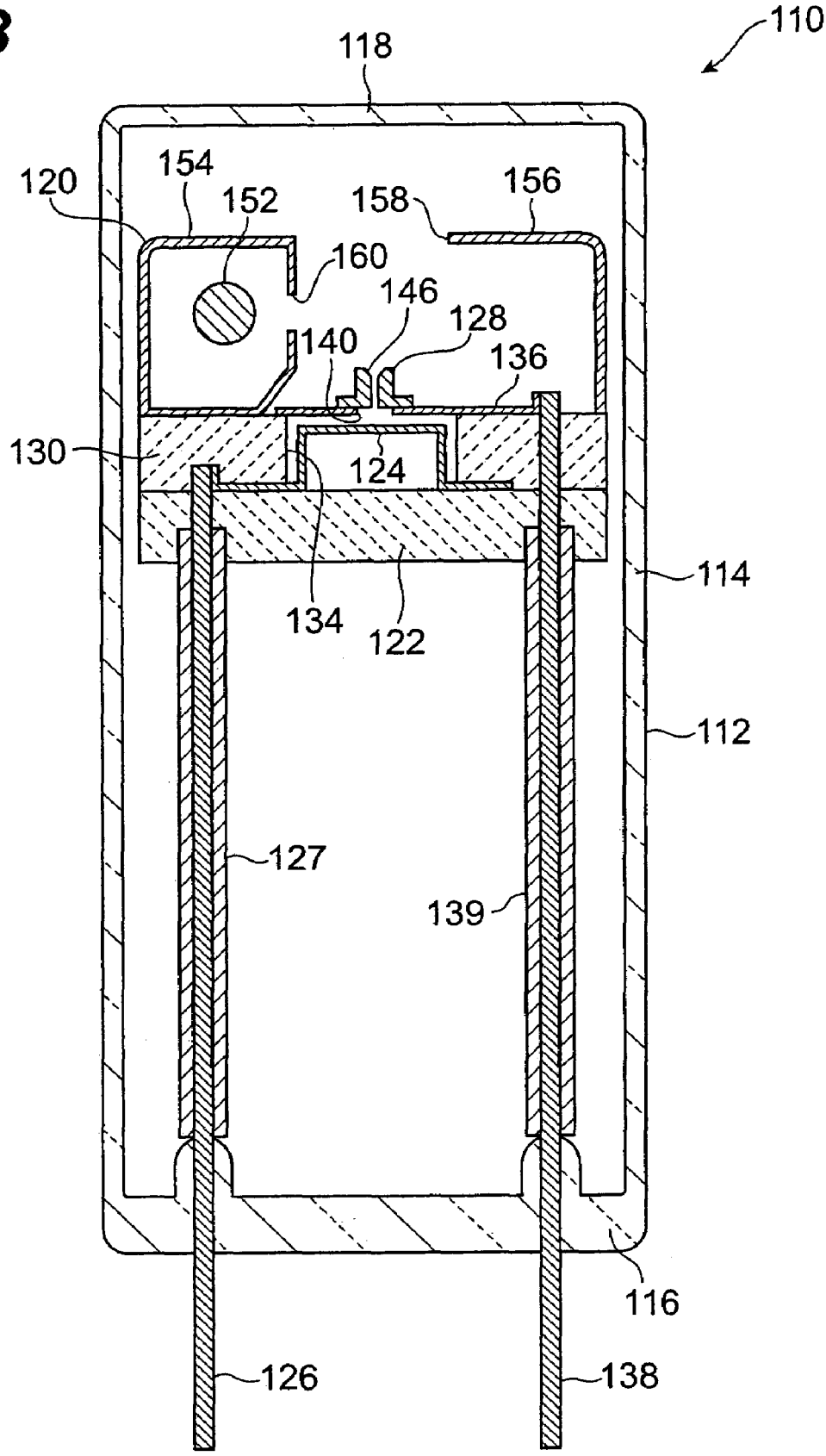
FIG. 3 is an end view showing a gas discharge tube according to a second embodiment of the present invention.

FIG. 3 is an end view showing a gas discharge tube according to a second embodiment of the present invention that is cut along the axial direction. A gas discharge tube 110 is a head-on type heavy hydrogen lamp, and has a sealed container 112 made of glass in which several hundreds of Pa of heavy hydrogen gas has been sealed. The sealed container 112 includes a side tube part 114 which is cylindrical; a stem part 116 for sealing the bottom end side of the side tube part 114; and a light emission window 118 for sealing the top end side of the side tube part 114. The sealed container 112 accommodates a light emission part assembly 120.

The light emission part assembly 120 includes a base part 122 which is discoid and electrically insulating, made of ceramics or the like. The base unit 122 is disposed opposed to the light emitting window 118. Over the base part 112 is formed an anode part 124. With the anode part 124, a tip portion of a stem pin 126 extending in the direction of the tube axis (the center axis of the side tube) standing on the stem part 116 is connected electrically. The stem pin 126 is wrapped with an electrically insulating tube 127 made of ceramics or the like so as not to be exposed between the stem part 116 and the base part 122.

The light emission part assembly 120 also has an electric-discharge-path-restricting-part supporting part (supporting part) 130, which is electrically insulating, made of ceramics or the like. The supporting part 130 is disposed and fixed onto the upper surface of the base part 122. In the center of the supporting part 130, a circular opening 134 is formed, into which the main portion of the anode part 124 is accommodated. When the main portion of the anode part 124 is disposed in the opening 134 and the supporting part 130 is laid and fixed onto the base part 122, the peripheral part of the anode part 124 is sandwiched between the supporting part 130 and the base part 122. The opening 134 of the supporting part 130 forms a part of the electric discharge path.

In addition, on the upper surface of the supporting part 130 is disposed a conductive plate 136. The conductive plate 136 is electrically connected with the tip portion of the stem pin 138 standing on the stem part 116. The stem pin 138 is also wrapped with an electrically insulating tube 139 made of ceramics or the like so as not to be exposed between the stem part 116 and the base part 122. The conductive plate 136 is provided with a circular opening 140 smaller than the inner diameter of the opening 134 of the supporting part 130. The opening 140 is disposed to be coaxial with the opening 134 of the supporting part 130 in a condition where the conductive plate 136 is fixed to the supporting part 130, thereby forming part of the electric discharge path.

In the center of the upper surface of the conductive plate 136, an electric discharge path restricting part 128 made of metal for narrowing or restricting the electric discharge path from the anode part 124 is fixedly welded in such a manner as to be coaxial with the openings 134 and 140. This enables electric power to be fed to the discharge path restricting part 128 from outside via the conductive plate 136 and the stem pin 138.

The electric discharge path restricting part 128 is substantially equivalent to the electric discharge path restricting part 28 of the first embodiment, that is, the one shown in FIG. 2. Therefore, when it is briefly described with the same reference marks and with reference to FIG. 2, the electric discharge path restricting part 128 is a cylinder having the flange 42 at one end thereof; the outer diameter "D" of the projecting part 44 is preferably in the range of 1.0 mm to 2.0 mm; letting the height of the projecting part 44 be "H," the relationship D/H with the outer diameter "D" of the projecting part 44 is preferably in the range of 0.5 to 2.0. The small hole part 48 of a throughhole 146 in the electric discharge path restricting part 128 has an inner diameter "d" of approximately 0.5 mm; the depth (length) "A" of the increased diameter hole part 150 is preferably in the range of 0.5 mm to 1.3 mm; and the opening angle θ is preferably in the range of 60° to 90°.

The light emission part assembly 120 also includes a cathode part 152 which is disposed outside the light path on the light emission window 118 side. The cathode part 152 is provided for generating thermal electrons, and to be more specific, is formed by coating electron emitting material onto a coil which is extended in the tube axial direction and is made of tungsten. The cathode part 152 is electrically connected with the tip portion of an unillustrated stem pin standing on the stem part 116 via a connection pin so as to allow feeding of electric power from outside.

The light emission part assembly 120 further includes an electric discharge distributor 154 made of metal and a front surface cover 156 in order to avoid materials spattered or evaporated from the cathode part 152 from adhering to the light emission window 118. The electric discharge distributor 154 is disposed to surround the cathode part 152 and fixed on the upper surface of the supporting part 130. The front surface cover 156 is opposed to the electric discharge distributor 154 and is fixed on the upper surface of the supporting part 130. Between the electric discharge distributor 154 and the front surface cover 156, a light passage opening 158 for letting discharge light pass through is formed. The electric discharge distributor 154 has an opening 160 in a portion that faces the front surface cover 156, and thermal electrons generated in the cathode part 152 pass through the opening 160.

The gas discharge tube 110 according to the second embodiment thus structured has the electric discharge path restricting part 128 which is substantially the same as its equivalent in the gas discharge tube 10 of the first embodiment, although there is a difference between a head-on type and a side-on type. In addition, the gas discharge tube 110 does not have a functional difference in the other parts thereof from the gas discharge tube 10, thereby bringing about effects of requiring a low voltage for a startup discharge and securing the generation of the startup discharge and the arc discharge. Furthermore, since the formed arc ball has a stable, excellent shape, the light to be emitted has high brightness and is sufficient and stable in amount. A detailed description of the behavior of the gas discharge tube 110 will be omitted because it is equal to that of the gas discharge tube 10.

THIRD EMBODIMENT

Figure 4:
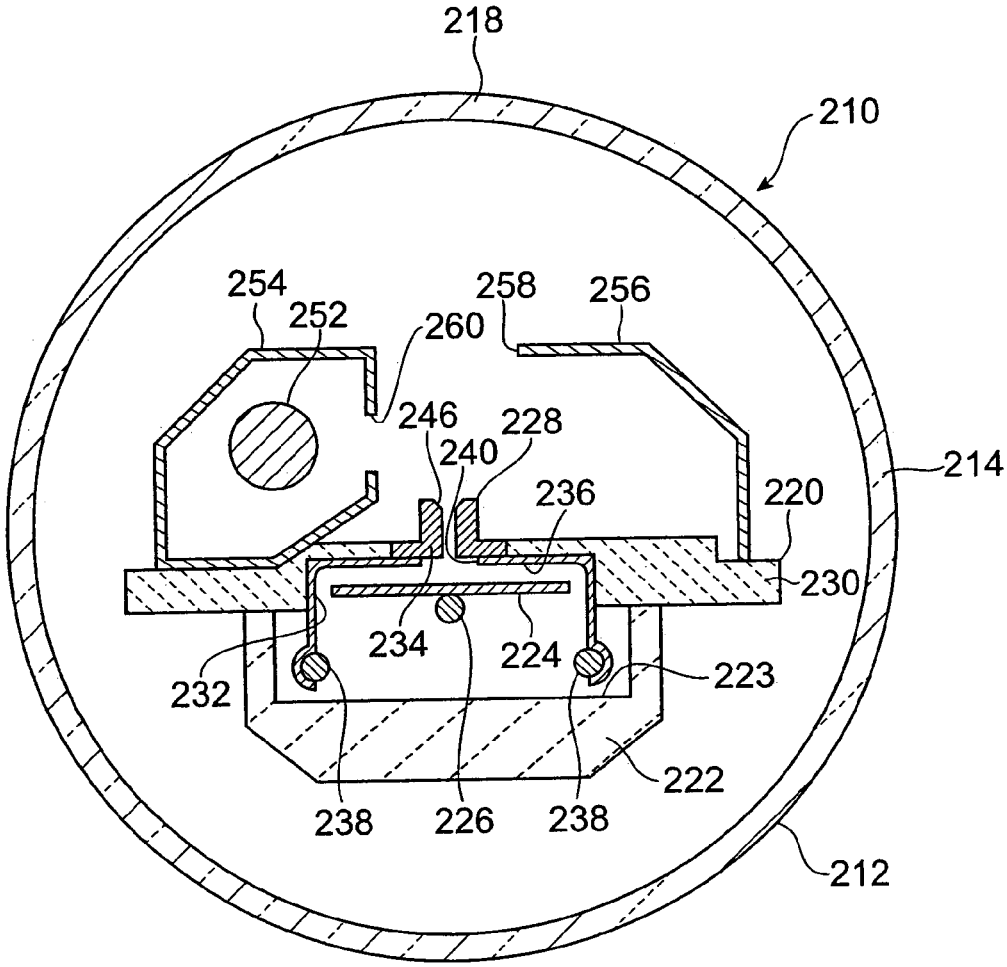
FIG. 4 is an end view showing a gas discharge tube according to a third embodiment of the present invention.

FIG. 4 is an end view showing a gas discharge tube according to a third embodiment of the present invention that is cut in the direction orthogonal to the axis (tube axis). Similar to the gas discharge tube 10 of the first embodiment, the gas discharge tube 210 of the third embodiment is a side-on type heavy hydrogen lamp. Specifically, the gas discharge tube 210 has a sealed container 212 made of glass in which several hundreds of Pa of heavy hydrogen gas is contained. The sealed container 212 is formed of a side tube part 214 which is cylindrical and sealed at one end thereof, and a stem part (nor shown) for sealing the other end of the side tube part 214. A portion of the side tube part 214 is used as a light emitting window 218. The sealed container 212 accommodates a light emission part assembly 220.

The light emission part assembly 220 includes a base part 222 which is electrically insulating, made of ceramics or the like. The base unit 222 is disposed opposed to the light emitting window 218, and has a concave part 223 on its upper surface. Over the base part 222 is formed a tabular anode part 224, and onto the rear side of the anode part 224, a tip portion of a stem pin 226, which extends in the direction of the tube axis and which stands on the stem part is fixedly connected electrically.

The light emission part assembly 220 also has an electric-discharge-path-restricting-part supporting part (supporting part) 230, which is tabular and made of ceramics or the like. The supporting part 230 is fixed on the top end surface of the outer peripheral surface of the base part 222. The supporting part 230 has a concave part 232 on the bottom surface center thereof. The bottom surface (downward surface) and side surfaces of the concave part 232 are distanced from the anode part 224 by a predetermined spacing. The supporting part 230 also has an opening 234 in its center.

In the opening 234 of the supporting part 230 is provided an electric discharge path restricting part 228 which is cylindrical and made of metal for narrowing the electric discharge path from the anode part 224. The attachment can be carried out by engaging the electric discharge path restricting part 228 into the opening 234 and welding them; however, in the third embodiment as clearly shown in FIG. 5, a female screw 235 is formed on the opening 234, and a male screw 237 is formed on the outer surface of the end of the electric discharge path restricting part 228, thereby screwing them.

Figure 5:
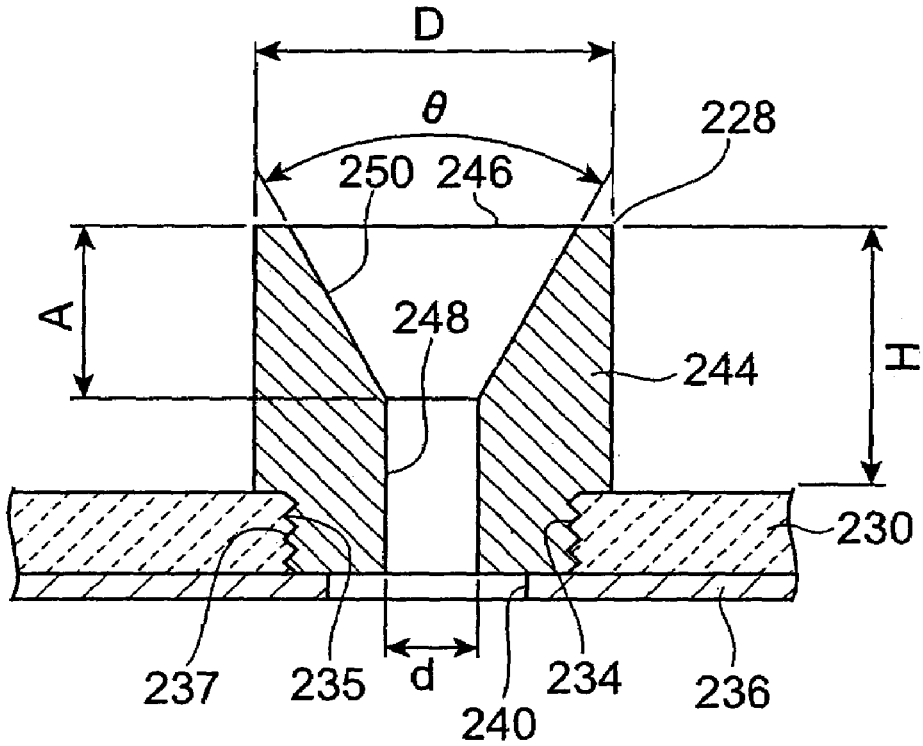
FIG. 5 is an enlarged cross sectional view of an electric discharge path restricting part in the gas discharge tube shown in FIG. 4.

As shown in FIG. 5, part of the electric discharge path restricting part 228 is screwed into the opening 234 of the supporting part 230, so that the part 244 corresponding to the projecting part 44 of the electric discharge path restricting part 28 shown in FIG. 2 projects from the upper surface of the supporting part 230. The outer diameter "D" of the projecting part 244 is preferably in the range of 1.0 mm to 2.0 mm, similar to the electric discharge path restricting part 28 shown in FIG. 2. Letting the height "H" of the projecting part 244 be "H," the relationship D/H with the outer diameter "D" of the projecting part 244 is preferably in the range of 0.5 to 2.0. The electric discharge path restricting part 228 also has a throughhole 246 for narrowing the electric discharge path, and the throughhole 246 is formed of a small hole part 248 having a constant inner diameter, and of an increased diameter hole part 250 which increases in diameter upward like a cone. The small hole part 248 is a part for mainly narrowing the electric discharge path, and has an inner diameter "d" of approximately 0.5 mm. The increased diameter hole part 250 is a part for mainly forming an arc ball, and has a depth "A" preferably in the range of 0.5 mm to 1.3 mm and an opening angle θ preferably in the range of 60° to 90°.

Furthermore, a conductive plate 236 is provided along the bottom and side surfaces of the concave part 232 of the supporting part 230. The conductive plate 236 is electrically connected with the tip portion of a stem pin 238 standing on the stem part. The conductive plate 236 is provided with an opening 240 aligned with the opening 234 of the supporting part 230. The portions partitioning the opening 240 of the conductive plate 236 are electrically connected with the bottom end of the electric discharge path restricting part 228. This enables electric power to be fed to the discharge path restricting part 228 from outside via the conductive plate 236 and the stem pin 238.

The light emission part assembly 220 also includes a cathode part 252 which is disposed outside the light path on the light emission window 218 side. The cathode part 252 is electrically connected with the tip portion of an unillustrated stem pin standing on the stem part via a connection pin so as to allow feeding of electric power from outside.

The light emission part assembly 220 further includes an electric discharge distributor 254 which is made of metal and surrounds the cathode part 252, and a front surface cover 256 which is formed in parallel with the electric discharge distributor 254 in order to avoid materials spattered or evaporated from the cathode part 252 from adhering to the light emission window 218. These are fixed on the upper surface of the supporting part 230, and between them is formed a light passage opening 258 for letting discharge light pass through. The electric discharge distributor 254 has an opening 260 through which to pass thermal electrons generated in the cathode part 252.

The gas discharge tube 210 of the third embodiment is lit as follows. In the same manner as in the gas discharge tube 10 of the first embodiment, for 20 seconds or so before an electric discharge, electric power of approximately 10W is supplied to the cathode part 252 from a cathode external power source (nor shown) via a stem pin (nor shown) so as to preheat the cathode part 252, and then a voltage of approximately 160V is applied between the cathode part 252 and the anode part 224 from a main discharge external power source (nor shown) via the stem pin 226, thereby preparing an arc discharge. Later, a predetermined voltage is applied between the electric discharge path restricting part 228 and the anode part 224 via the stem pins 238 and 226 from a trigger external power source (nor shown). As a result, a startup discharge occurs between the cathode part 252 and the tip of the projecting part 244 of the electric discharge path restricting part 228 that projects toward the cathode part 252 side. The occurrence of the startup discharge is followed by the generation of a main discharge between the cathode part 252 and the anode part 224 due to a main discharge external electrode. Later, the electric power from the cathode external power source is adjusted to optimize the temperature of the cathode part 252. This maintains the main discharge between the cathode part 252 and the anode part 224, and forms an arc ball inside the increased diameter hole part 250 of the projecting part 244 in the electric discharge path restricting part 228.

The outer diameter "D" of the projecting part 244; the ratio of the outer diameter "D" to the height "H," that is, D/H; and the depth "A" and opening angle θ of the increased diameter hole part 250 with a conical shape in the electric discharge path restricting part 228 of the third embodiment are equal to those of the aforementioned electric discharge path restricting parts 28 and 128. This makes it possible to decrease the startup voltage for generating the startup discharge, and also to generate an arc ball with a stable, excellent shape, thereby stabilizing the brightness and amount of light to be emitted.

As described hereinbefore, the gas discharge tube of the present invention can obtain high brightness because of the provision of the electric discharge path restricting part for narrowing an electric discharge path. The gas discharge tube can also decrease the startup voltage because of the unique shape of the electric discharge path restricting part, regardless of its length, thereby facilitating the generation of the startup discharge. The easy generation of the startup discharge secures the generation of the main discharge. Furthermore, the shape of the electric discharge path restricting part stabilizes the brightness and amount of the light emitted.

Although the present invention and its advantages can be understood hereinbefore, it is obvious that the above-described embodiments are only typical preferable embodiments, and various modifications can be carried out in shape, structure and arrangement, without deviating from the spirit and scope of the present invention or losing the substantial advantages.

The invention claimed is:

1. A gas discharge tube comprising:

a sealed container in which gas is contained;

an anode part disposed in said sealed container;

a cathode part defining an electric discharge part for generating an electric discharge with said anode part, said cathode part being disposed inside said sealed container in such a manner as to be distanced from said anode part;

an electric discharge path restricting part being cylindrical and conductive and having a throughhole for narrowing said electric discharge path, said electric discharge path restricting part being disposed between said anode part and said cathode part, and being adapted to be electrically connected with an external power source; and an electric-discharge-path-restricting-part supporting part for supporting said electric discharge path restricting part, said supporting part being electrically insulating, wherein said electric discharge path restricting part has a projecting part which is cylindrical and projects toward said cathode part side, and a ratio (D/H) of an outer diameter (D) of said projecting part to a height (H) of said projecting part is in a range of 0.5 to 2.0.

2. The gas discharge tube according to claim 1, wherein the outer diameter of said projecting part of said electric discharge path restricting part is in a range of 1.0 mm to 2.0 mm.

3. The gas discharge tube according to claim 1, wherein said throughhole in said electric discharge path restricting part includes a small hole part which is provided on said anode part side and has a constant inner diameter, and an increased diameter hole part which is linked with said small hole part and extends toward said cathode part side.

4. The gas discharge tube according to claim 3, wherein said increased diameter hole part has a conical inner peripheral surface, a depth (A) in a range of 0.3 mm to 1.3 mm and an opening angle (θ) in a range of 60° to 90°.

5. The gas discharge tube according to claim 1, wherein the gas in said sealed container is heavy hydrogen gas.

* * * * *